US009128441B2

(12) United States Patent
Masuda et al.

(10) Patent No.: US 9,128,441 B2
(45) Date of Patent: Sep. 8, 2015

(54) IMAGE FORMING APPARATUS AND IMAGE FORMING METHOD

(71) Applicants: Koji Masuda, Kanagawa (JP); Hidemasa Suzuki, Kanagawa (JP); Susumu Momma, Kanagawa (JP)

(72) Inventors: Koji Masuda, Kanagawa (JP); Hidemasa Suzuki, Kanagawa (JP); Susumu Momma, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 13/895,585

(22) Filed: May 16, 2013

(65) Prior Publication Data

US 2013/0308966 A1 Nov. 21, 2013

(30) Foreign Application Priority Data

May 18, 2012 (JP) ..... 2012-114820
May 18, 2012 (JP) ..... 2012-114824

(51) Int. Cl.
*G03G 15/00* (2006.01)
*G03G 15/20* (2006.01)

(52) U.S. Cl.
CPC ..... *G03G 15/55* (2013.01); *G03G 15/2053* (2013.01)

(58) Field of Classification Search
CPC ..... G03G 15/55; G03G 15/2053
USPC ..... 399/33, 67, 345, 347
See application file for complete search history.

(56) References Cited

U.S. PATENT DOCUMENTS

| | | | | |
|---|---|---|---|---|
| 5,778,280 | A * | 7/1998 | Komiya et al. | 399/49 |
| 8,768,191 | B2 * | 7/2014 | Maruko | 399/67 |
| 2005/0185978 | A1 | 8/2005 | Kemmochi | |
| 2009/0238590 | A1 | 9/2009 | Masuda | |
| 2010/0008686 | A1 | 1/2010 | Masuda et al. | |
| 2010/0266302 | A1 | 10/2010 | Suzuki et al. | |

(Continued)

FOREIGN PATENT DOCUMENTS

| | | |
|---|---|---|
| JP | 5-113739 | 5/1993 |
| JP | 6-27851 | 2/1994 |

(Continued)

OTHER PUBLICATIONS

English Translation of Nobuatsu (JPH05113739).*

(Continued)

*Primary Examiner* — Clayton E Laballe
*Assistant Examiner* — Ruifeng Pu
(74) *Attorney, Agent, or Firm* — Oblon, McClelland, Maier & Neustadt, L.L.P.

(57) ABSTRACT

An image forming apparatus includes a charging device configured to uniformly charge a surface of a photoconductive element; an image writing device configured to write an image in the charged photoconductive element by light to form an electrostatic latent image; a developing device configured to visualize the formed electrostatic latent image as a toner image; a transfer device configured to transfer the toner image to a sheet recording medium; a fixing device configured to fix the transferred toner image onto the medium; and a surface information detecting device configured to detect surface information of a fixing member of the fixing device. The surface information detecting device radiates optical spots on a surface of the fixing member in a direction crossing a conveying direction, receives reflected light of each optical spot, and detects the surface information of the fixing device based on the detection results of the reflective lights.

14 Claims, 12 Drawing Sheets

(56) References Cited

U.S. PATENT DOCUMENTS

| | | | |
|---|---|---|---|
| 2010/0310284 | A1 | 12/2010 | Funato et al. |
| 2011/0043810 | A1 | 2/2011 | Suzuki et al. |
| 2011/0044713 | A1 | 2/2011 | Masuda et al. |
| 2012/0268750 | A1 | 10/2012 | Masuda |

FOREIGN PATENT DOCUMENTS

| | | | |
|---|---|---|---|
| JP | 6-221836 | | 8/1994 |
| JP | 11-94750 | | 4/1999 |
| JP | 2005-266785 | | 9/2005 |
| JP | 2006-251165 | | 9/2006 |
| JP | 2007-034068 | | 2/2007 |
| JP | 2008-268524 | A | 11/2008 |
| JP | 2008-286791 | A | 11/2008 |
| JP | 2009-237250 | A | 10/2009 |
| JP | 2010-060910 | | 3/2010 |
| JP | 2010-191275 | A | 9/2010 |
| JP | 2010-262023 | A | 11/2010 |
| JP | 2011-118120 | A | 6/2011 |

OTHER PUBLICATIONS

Office Action mailed Feb. 24, 2015, in Japanese Patent Application No. 2012-114820.

Office Action mailed Feb. 24, 2015, in Japanese Patent Application No. 2012-114824.

* cited by examiner (a) CONTACTING STATE (b) SEPARATED STATE

IMAGE FORMING APPARATUS AND IMAGE FORMING METHOD

CROSS-REFERENCE TO RELATED APPLICATIONS

The present application claims priority to and incorporates by reference the entire contents of Japanese Patent Application No. 2012-114820 filed in Japan on May 18, 2012 and Japanese Patent Application No. 2012-114824 filed in Japan on May 18, 2012.

BACKGROUND OF THE INVENTION

1. Field of the Invention

The present invention relates to an image forming apparatus and an image forming method.

2. Description of the Related Art

Conventionally, an image forming apparatus which adopts a scheme of uniformly charging a photoconductive photoconductive element, "writing an image by means of a light (optical image radiation or optical writing)" on the uniformly charged photoconductive element, forming an electrostatic latent image corresponding to a written image, obtaining a toner image obtained by developing this electrostatic latent image, transferring the obtained toner image to "a sheet recording medium such as a transfer sheet" and fixing the toner image to the sheet recording medium is widely known as a copying machine or a MFP (multi function printer).

In this image forming apparatus, the fixing device "fixes a toner image on, for example, a transfer sheet", and, if the fixing device does not appropriately function, good image formation is not performed.

Although the toner image to be fixed is a monochrome image, the toner image is usually "a color toner image obtained by mutually overlaying a plurality of toner images of different colors" in a recent image forming apparatus.

Although there are various types of fixing devices, many types which pinch and convey "a sheet recording medium to which a toner image is transferred" by means of a pair of rotating bodies, applies heat and a pressure to the toner image and fuses the toner image to the sheet recording medium. "Pinching and conveying" a sheet recording medium refers to "compression conveying" a sheet recording medium.

Individual rotating bodies generally adopt forms of "rollers or belts", and a configuration of a pair of rotating bodies can include a combination of rollers, a combination of belts or a combination of a belt and a roller.

One of a pair of rotating bodies which contacts on a surface side of a sheet recording medium, that is, a surface on a side on which a toner image is formed is referred to as a "fixing member".

The fixing member which is formed in a roller shape is also referred to as a "fixing roller". Further, the fixing member which is formed in a belt shape is also referred to as a "fixing belt". The fixing belt is wound around "a plurality of rollers including driving rollers", and is driven to rotate.

"A direction" in which a surface of the fixing member "moves by way of rotation of the fixing member" corresponds to a direction in which a recording sheet is compression conveyed, and therefore this direction on the surface of the fixing member is referred to as a "conveying direction".

The surface of the fixing member contacts a toner image to be fixed, and is adhered with "part of toner which forms a toner image" upon fixing. The toner adhered to the fixing member surface in this way is adhered (also referred to as "offset") to the fixing member surface if left, and attached to a non-image portion on a sheet recording medium surface, thereby causing fixing failure.

To avoid this, a cleaning unit such as a brush is slid against the surface of a sheet recording medium and removes adhered toner in many cases. Further, a peeling claw which peels "a sheet recording medium to which a toner image is fixed" from the fixing member surface or a temperature detecting unit (thermistor) which detects a surface temperature of the fixing member abut on the surface of the fixing member in some cases.

These cleaning unit, the peeling claw and the thermistor physically contact a fixing member surface, and therefore this physical contact "abrades or damages" the surface of the fixing member.

When the surface of the fixing member is abraded or damaged to some degree, the fixing member cannot exercise the function, and therefore this fixing member is exchanged.

Although damage on a fixing member is caused by "contact with the cleaning unit, the peeling claw or the thermistor", the cause of the damage is not limited to this. There is "a damage resulting from a fixing operation itself".

Upon fixing, a pair of rotating bodies compression conveys a sheet recording medium, and a surface of a fixing member receives "a reaction of a compression force" from the sheet recording medium.

The sheet recording medium is generally a "transfer sheet", and is cut into a standard shape such as an A4 size or a B5 size.

An edge portion (a ridge portion between a surface of a transfer sheet and a cutting end surface) of a cutting portion (a portion which forms a thickness of an end portion) of a transfer sheet is sharp, and, upon fixing, a force concentrates on a contact portion contacting a transfer member surface and therefore is likely to produce "a scratch like a slit" on the surface of the fixing member. That the "edge portion" is sharp is understood from the fact that "a finger is cut by an edge of paper" when paper is used in a daily scene.

A scratch is produced by the edge portion of the sheet recording medium like "a streak in the conveying direction" on the surface of the fixing member, and will be referred to as "a streaky scratch" below.

In addition to the above cause, a "streaky scratch" is caused when a transfer sheet is cut into a standard size and "(hard particle) paper additive represented by calcium carbonate" is exposed to a cutting surface.

When the additive exposed to the cutting surface is adhered to the fixing member surface along the cutting plane, a nipping portion which compression conveys a transfer sheet is pressed against the fixing member surface, and a stress concentrates on minute particles, thereby damaging the fixing member surface. Particularly, this is likely to happen when the surface of the fixing member is a hard material.

In case of a plastic sheet for an overhead projector which is frequently used as a sheet recording medium other than a transfer sheet, a "streaky scratch" is also likely to be produced.

Such a "streaky scratch" not only negatively affects the life of a fixing member but also negatively affects image quality.

A case will be described as an example where an image forming apparatus forms images on A3 size and A4 size transfer sheets, and "fixes" these two types of transfer sheets "while conveying" the transfer sheets "in a longitudinal direction".

In this case, although the width (the length in a direction orthogonal to the conveying direction) of the A4 size transfer sheet to be conveyed is narrower than that of the A3 size, the "streaky scratch" is produced at "a width direction end portion of the A4 size and the width direction end portion of the A3 size" in fixing areas.

When the fixing member in which the "streaky scratch" is produced at the width direction end portion of the A4 size performs fixing with respect to the A3 size transfer sheet, the "streaky scratch" is in a transfer area of the A3 size, a contact pressure of the fixing member and a toner image weakens at a scratch portion, "fixing failure" occurs along the streaky scratch, and a "streaky image abnormality" which is referred to as "picking (a decrease that an image density decreases)" occurs in the fixed image.

In case of a scratch resulting from contact with the above "peeling claw or thermistor", a similar image abnormality also occurs.

"A fixing member of which surface condition is deteriorated" by "adhered ("offset") toner", "a scratch resulting from contact with a peeling claw or a thermistor" or "a streaky scratch" causes fixing failure as described above.

A method of detecting a condition of the "fixed ("offset") toner" on a fixing member surface or a condition of the above "scratch resulting from contact with the peeling claw or the thermistor" is proposed (Japanese Patent Application Laid-open No. 5-113739).

By contrast with this, a technique of detecting the degree of a scratch (such as a depth or a width of a scratch) of the above "streaky scratch" is not known.

Japanese Patent Application Laid-open No. 2006-251165 (Japanese Patent Application Laid-open No. 2007-34068) discloses a countermeasure of dealing with the above "deterioration of a surface condition of a fixing member".

The method disclosed in Japanese Patent Application Laid-open No. 2006-251165 among the countermeasures disclosed in these Patent Literatures includes optically specifying "information about a surface condition" and controlling an exposing unit in case that "the amount of adhered toner increases" at a portion at which a scratch is produced.

According to this method, no countermeasure is taken for a scratch of the fixing member, and deterioration of the fixing member progresses as is.

The method disclosed in Japanese Patent Application Laid-open No. 2007-34068 includes exposing "a new surface" on a fixing belt surface by having tension rollers which have coarser surfaces than the surface of the fixing belt "constantly slide" against the surface of the fixing member (fixing belt). According to this method, the fixing belt surface is worn away due to constant sliding, and therefore the life of the fixing belt is made shorter more than necessary.

Therefore, there is a need to provide an image forming apparatus which can effectively detect a condition of a fixing member surface, that is, not only the offset and "a scratch resulting from contact with a peeling claw or a thermistor" but also "a streaky scratch produced by contact with the sheet recording medium" in particular.

SUMMARY OF THE INVENTION

It is an object of the present invention to at least partially solve the problems in the conventional technology.

According to an embodiment, there is provided an image forming apparatus that includes a photoconductive photoconductive element; a charging device configured to uniformly charge a photoconductive surface of the photoconductive element; an image writing device configured to write an image in the charged photoconductive element by means of light to form an electrostatic latent image; a developing device configured to visualize the formed electrostatic latent image as a toner image; a transfer device configured to transfer the toner image to a sheet recording medium; a fixing device configured to fix the transferred toner image onto the sheet recording medium; and a surface information detecting device configured to detect surface information of a fixing member of the fixing device. The surface information detecting device radiates a plurality of optical spots on a surface of the fixing member in a direction crossing a conveying direction, receives and detects a reflected light of each optical spot, and detects the surface information of the fixing device based on a plurality of detection results of the reflective lights.

According to another embodiment, there is provided an image forming method that includes uniformly charging a photoconductive surface of a photoconductive element; writing an image in the charged photoconductive element by means of light to form an electrostatic latent image; visualizing the formed electrostatic latent image as a toner image; transferring the toner image to a sheet recording medium; fixing the transferred toner image to the sheet recording medium by a fixing device; radiating a plurality of optical spots on a surface of a fixing member of the fixing device in a direction crossing a conveying direction; receiving and detecting reflective lights of respective optical spots; and detecting surface information of the surface of the fixing member based on a plurality of detection results of the reflective lights.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, the best mode for implementing the present invention will be described.

Figure 1A:
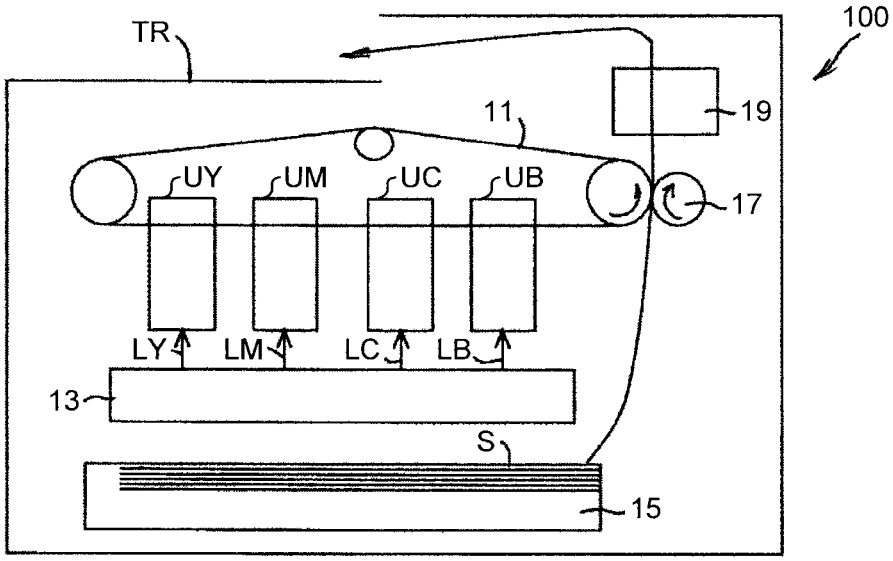
FIGS. 1A to 1C are views for explaining an example of a configuration of an image forming apparatus.
Figure 1B:
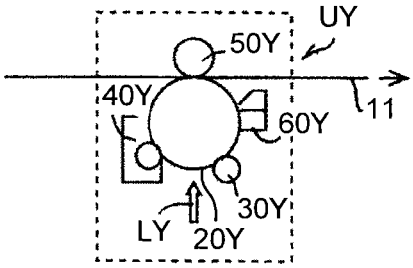
Figure 1C:
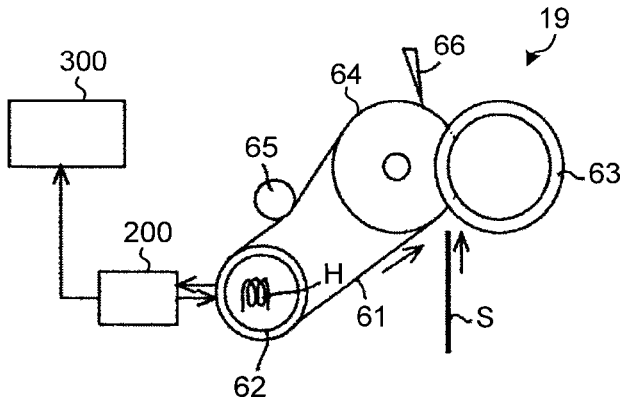

FIGS. 1A to 1C are views for explaining a "color printer" which is one type of an image forming apparatus. Meanwhile, as described above, the image forming apparatus according to the present invention is not limited to the color printer illustrated in FIGS. 1A to 1C, and it goes without saying that the image forming apparatus can be implemented as a monochrome copying machine, a color copying machine, a facsimile device or a plotter device, or an MFP in which these functions are combined.

FIG. 1A illustrates only relevant portions of a color printer 100. The color printer 100 is a so-called "tandem printer".

"A transfer belt which is an intermediate transfer body" denoted by a reference numeral 11 is an endless belt, is provided by being wound around a plurality of (three rollers in the drawing) rollers and rotates in a counterclockwise direction by being driven by one driving roller of these rollers.

A lower side portion of the transfer belt 11 in the drawing is stretched "planarly", and image forming units UY, UM, UC and UB are arranged at this portion. Meanwhile, "Y, M, C and B" as reference numerals denote respective colors of "yellow, magenta, cyan and black", and an image forming unit UY is a unit which forms a yellow image, an image forming unit UM is a unit which forms a magenta image, an image forming unit UC is a unit which forms a cyan image and an image forming unit UB is a unit which forms a black image.

Below the image forming units UY to UB, an optical scanning device 13 which is an "image writing device" is arranged, and, below the optical scanning device 13, a cassette 15 is arranged.

The image forming units UY to UB adopt the same structure, and therefore will be simply described using the image forming unit UY as an example with reference to FIG. 1B.

The image forming unit UY illustrated in FIG. 1B has a photoconductive drum 20Y which is a photoconductive photoconductive element, and adopts a structure in which a charger 30Y, a developing unit 40Y, a transfer roller 50Y and a cleaning unit 60Y are arranged around the photoconductive drum 20Y.

The charger 30Y is a "contact roller charging device".

A portion between the charger 30Y and the developing unit 40Y is set as "an image write portion of a scanning light LY". The transfer roller 50Y is arranged on an opposite side of the photoconductive drum 20Y across the transfer belt 11, and is in contact with a bottom surface of the transfer belt 11.

The image forming units UM to UB also employ the same configuration as that of the image forming unit UY, and, when necessary, photoconductive drums 20M to 20B, chargers 30M to 30B, developing units 40M to 40B, transfer rollers 50M to 50B and cleaning units 60M to 60B will be assigned, respectively.

Although "color image printing process" of the color printer 100 is well known, this will be simply described below. In addition, "a rectangular shape indicated by a broken line" in FIG. 1B "collectively" illustrates units of the image forming unit UY, and does not necessarily indicate an entity such as a casing.

When color image forming process starts, the photoconductive drums 20Y to 20B and the transfer belt 11 start rotating. The photoconductive drums 20Y to 20B rotate in a clockwise direction, and the transfer belt 11 rotates in a counterclockwise direction.

Photoconductive surfaces of the photoconductive drums 20Y to 20B are uniformly charged by the chargers 30Y to 30B. An optical scanning device 13 optically scans by means of scanning lights LY to LB and writes images on the photoconductive drums 20Y to 20B.

In addition, various types of optical scanning devices are conventionally known as the optical scanning device 13 which writes images in this way, and a known optical scanning device is adequately used as the optical scanning device 13.

The photoconductive drum 20Y is optically scanned using, as the scanning light LY, a laser beam of which intensity is modulated according to a yellow image, a yellow image is written therein and an electrostatic latent image matching the yellow image is formed.

The formed electrostatic latent image is a so-called negative latent image, and is visualized as "a yellow toner image" by reversal development using yellow toner by the developing unit 40Y.

The visualized yellow toner image is electrostatically primarily transferred on a surface side of the transfer belt 11 by the transfer roller 50Y.

The photoconductive drum 20M is optically scanned using, as the scanning light LM, a laser beam of which intensity is modulated according to a magenta image, a magenta image is written therein and an electrostatic latent image (negative latent image) matching the magenta image is formed.

The formed electrostatic latent image is visualized as a "magenta toner image" by reversal development using magenta toner by the developing unit 40M.

The photoconductive drum 20C is optically scanned using, as the scanning light LC, a laser beam of which intensity is modulated according to a cyan image, a cyan image is written therein and an electrostatic latent image (negative latent image) matching the cyan image is formed.

The formed electrostatic latent image is visualized as a "cyan toner image" by reversal development using cyan toner by the developing unit 40C.

The photoconductive drum 20B is optically scanned using, as the scanning light LB, a laser beam of which intensity is modulated according to a black image, a black image is written therein and an electrostatic latent image (negative latent image) matching the black image is formed.

The formed electrostatic latent image is visualized as a "black toner image" by reversal development using black toner by the developing unit 40B.

Although a magenta toner image is electrostatically transferred primarily to a transfer belt 11 side by the transfer roller 50M, in this case, the magenta toner image is overlaid on "the yellow toner image which is transferred in advance" to the transfer belt 11.

Similarly, the cyan toner image is overlaid on and primarily transferred to "the yellow toner image and the magenta toner image which are overlaid in advance" on the transfer belt 11 by the transfer roller 50C. The black toner image is overlaid on and is primarily transferred to yellow, magenta and cyan toner images on the transfer belt 11 by the transfer roller 50B.

By this means, four color toner images of yellow, magenta, cyan and black images are overlaid on the transfer belt 11 to form a "color toner image".

In addition, the photoconductive drums 20Y to 20B are cleaned by the cleaning units 60Y to 60B after toner images are transferred thereto to remove remaining toner and paper dust.

Thus, the color toner image formed on the transfer belt 11 is electrostatically "transferred secondarily" onto a transfer sheet S which is a sheet recording medium by a secondary transfer roller 17 from the transfer belt 11, is fixed on the transfer sheet S by the fixing device 19 and is discharged outside the printer.

The transfer sheet S is stacked and accommodated in the cassette 15, is fed by a known feeding mechanism which is not illustrated, stands by with an end portion held by an operational timing roller (also referred to as a "registration roller") which is not illustrated, and is sent to a secondary transfer portion in synchronization with an operational timing of movement of the color toner image on the transfer belt 11.

The secondary transfer portion is an abutting portion of the transfer belt 11 and the secondary transfer roller 17 which rotates in contact with the transfer belt 11, and the transfer sheet S is sent out to the secondary transfer portion by the operational timing roller in synchronization with the operational timing when the color toner image on the transfer belt 11 reaches the secondary transfer portion.

Thus, the color toner image and the transfer sheet S are overlaid, and the color toner image is electrostatically transferred onto the transfer sheet S.

The transfer sheet S to which the color toner image is transferred by way of secondary transfer has the color toner image be fixed thereon when passing through the fixing device 19 and is discharged onto a tray TR above the color printer 100.

"The color image printing process" of the color printer 100 has been roughly described above.

Next, the fixing device 19 of the color printer in FIG. 1A will be described with reference to FIG. 1C.

The fixing device 19 adopts a so-called "belt fixing scheme" as illustrated in FIG. 1C, and, as illustrated, the fixing portion has a heating roller 62, a fixing portion roller 64, a pressing roller 63, a tension roller 65 and a peeling claw 66 in addition to the fixing belt 61 as a fixing member.

The fixing belt 61 has "a release layer made of PFA or PTFE" as a base material such as nickel or polyimide, and is provided with "an elastic layer such as silicon rubber" between these base materials and the release layer.

Hence, the surface of the fixing belt 61 is "resin such as PFA or PTFE which serves as a release layer", and information about this surface is a detection target.

The fixing belt 61 is an endless belt, is wound around the heating roller 62 and the transfer roller 64 and is given "a necessary tension" by the tension roller 65.

The heating roller 62 is a hollow roller made of aluminum or iron and includes a heat source H such as a halogen heater, and the heat source H heats the fixing belt 61 through the heating roller 62. In addition, although not illustrated, a temperature sensor (for example, thermopile) which detects a surface temperature of the fixing belt 61 is provided "non-contact" on the surface of the fixing belt 61.

The fixing roller 64 includes a metal cored bar surrounded by silicone rubber, and is given elasticity. The fixing roller 64 drives the fixing belt 61 to rotate in the counterclockwise direction.

The pressing roller 63 has an elastic layer such as silicone rubber on a cored bar such as aluminum or iron, and the surface layer is formed with a release layer such as PFA or PTFE.

The pressing roller 63 pressure contacts with the fixing belt 61 at a position meeting the fixing roller 64. This pressure-contact deforms the fixing roller 64 and forms "a nipping portion". This nipping portion forms the fixing portion.

The tension roller 65 has silicon rubber around the metal cored bar.

The peeling claw 66 has a plurality of sharp portions in the shaft direction of the fixing roller 64 (a vertical direction in the drawings) such that the sharp portions abut on the surface of the fixing belt 61.

Although a non-contact temperature sensor (not illustrated) which detects the surface temperature of the fixing belt 61 is provided as described above, it is also possible to use a contact temperature sensor (thermistor) instead.

Upon fixing, the fixing belt 61 rotates in the counterclockwise direction and the pressing roller 63 rotates in the clockwise direction while being heated by a heater H, and, when the surface temperature of the fixing belt 61 becomes a temperature at which fixing can be performed, the transfer sheet S to which a color toner image is transferred is conveyed in an arrow direction and enters the fixing portion.

Further, a color toner image is heated at the transfer portion by the fixing belt 61 side, is pressed against the fixing belt 61 by the pressing roller 63, then is pressurized and is fixed onto the transfer sheet S.

To add to this, the color printer 100 has a cleaning device (not illustrated) which cleans the transfer belt 11.

This "cleaning device" has a cleaning brush or a cleaning blade which are provided to abut on the transfer belt 11 facing with a portion of the transfer belt 61 which is wound around the roller in the left direction of the image forming unit UY in FIG. 1A, and the cleaning brush and the cleaning blade scratch and remove "abnormal objects such as remaining toner or paper dust" on the transfer belt 11 to clean the transfer belt 11.

The cleaning device also has a discharging unit (not illustrated) which conveys and discards remaining toner removed from the transfer belt 11.

Although the image forming apparatus illustrated in FIGS. 1A to 1C adopts, for example, a transfer scheme which is "a scheme of sequentially superimposing on the transfer belt 11 the color toner images formed on the photoconductive drums 20Y to 20B, primarily transferring the color toner images and collectively transferring the transferred color toner images onto the transfer sheet S by means of the secondary transfer roller 17", the transfer scheme is not limited to this.

The image forming apparatus can also adopt, for example, a scheme of carrying the transfer sheet S on the transfer belt 11, conveying the transfer sheet S to face and contact with the photoconductive drums and directly superimposing and transferring toner images of respective colors onto the transfer sheet S. In this case, a color toner image may also be fixed as described above.

Further, in the image forming apparatus (color printer 100) illustrated in FIGS. 1A to 1C, the fixing device 19 has "a surface information detecting device" which detects surface information of the fixing member (fixing belt 64).

Although the surface information detecting device "radiates a plurality of optical spots on the surface of the fixing member in a direction which crosses a conveying direction, receives and detects reflected lights from the respective optical spots and detects surface information of the fixing member surface based on a plurality of detection results", the surface information detecting device is formed with a reflective photo sensor 200 and the surface information detecting device 300 in the present embodiment.

Figure 10:
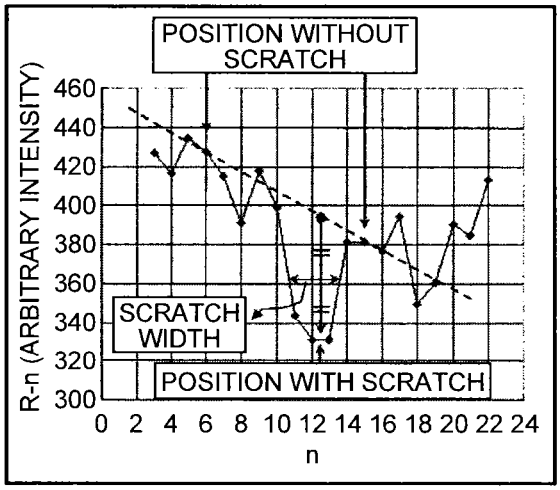
FIG. 10 is a view for explaining detection of a scratch width.

As illustrated in FIG. 10, the reflective photo sensor 200 is arranged facing with "a portion" of the fixing belt 61 "which is wound around the heating roller 62", and has a radiation unit which radiates a plurality of optical spots "on the surface of the fixing belt 61 in a direction which crosses the conveying direction" toward the surface of the fixing belt 61 and a sensor unit which receives reflected lights from the fixing belt 61.

The above "direction which crosses the conveying direction on the surface of the fixing belt 61" corresponds to "a main-scanning direction" when an image is written by way of optical scanning, and therefore will be referred to simply as "a main-scanning direction" below.

The surface information detecting device 300 is connected to the reflective photo sensor 200, is arranged in the color printer 100, receives a detection signal from the reflective photo sensor 200 and detects a surface condition of the fixing belt 61 as surface information.

The surface of the fixing belt 61 which is the fixing member is originally undamaged, and, as a fixing operation is repeated, the above offset, a scratch resulting from contact with, for example, the peeling claw 66 and "a streak scratch" produced by a sheet recording member are produced.

This "condition of a surface on which a scratch and an offset are produced", that is, "whether or not an offset occurs, the degree of offset and a condition or a position of a scratch" is a surface condition and "surface information".

Detection of surface information of "a streaky scratch" will be mainly described below.

Figure 2:
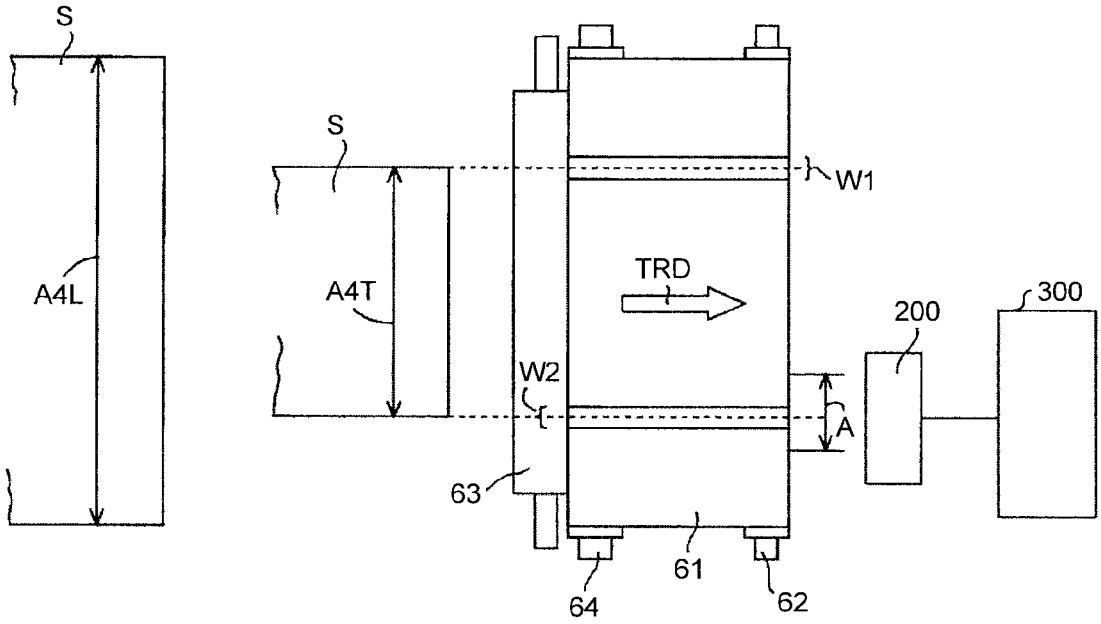
FIG. 2 is a view as an explanatory view illustrating a fixing device.

FIG. 2 is a view as an explanatory view illustrating fixing by the fixing device 19.

An up and down direction in FIG. 2 corresponds to "a direction (the above main-scanning direction) which crosses a conveying direction TRD on the surface of the fixing belt 61".

A reference numeral S denotes a transfer sheet which has a color toner image to be fixed. In this example, the transfer sheet S has "an A4 size", and can be conveyed in a longitudinal direction and a width direction. A reference numeral A4T denotes a sheet width when the A4 size transfer sheet S is conveyed in the longitudinal direction, and a reference numeral A4L denotes a sheet width when the A4 size transfer sheet S is conveyed in the width direction (lateral direction).

In this case, although a transfer sheet of the same size is conveyed "in states in which widths are different in the conveying direction", this case is also an example of "sheet recording media of a plurality of sizes of different widths in the conveying direction".

A sheet width A4L is virtually equal to the width of the fixing belt 61 (the length in the up and down direction in the drawings), and, when the A4 size transfer sheet S is conveyed in the width direction (lateral direction), a streaky scratch produced at an end portion in the longitudinal direction does not actually matter very much.

Meanwhile, the sheet width A4T is narrower than the width of the fixing belt 61, and a streaky scratch is produced on an inner side of the sheet width A4L and causes the above problem.

Reference numerals W1 and W2 in FIG. 2 denote "clearances" of movement of a transfer sheet width end portion in the main-scanning direction when the A4 size transfer sheet S is conveyed in the longitudinal direction.

Even if the A4 size transfer sheet S is conveyed in the longitudinal direction, it is not possible to "completely match a conveying position in the main-scanning direction with each transfer sheet" and passing positions of both end portions of the transfer sheets slightly fluctuate in the main-scanning direction.

Alternatively, when a so-called "belt slack" of the fixing belt 61 occurs, the fixing belt surface fluctuates toward the both end portions of the transfer sheet S in the main-scanning direction.

The clearances W1 and W2 are set taking this fluctuation into account.

Further, when a fluctuation range of a position at which the transfer sheet S and the fixing belt 61 contact is "narrow", a streaky scratch also concentrates on a narrow range, and therefore when a transfer sheet is conveyed, "a conveying position in the main-scanning direction" is intentionally shifted per transfer sheet.

The clearances W1 and W2 are also taken into account in this case. However, the clearance is about "10 mm" at maximum.

Thus, when the clearances: W1 and W2 are taken into account and the A4 size transfer sheet S is fed in the longitudinal direction, if "whether or not there is a streaky scratch" is detected as a surface condition, a detection area A needs to be set greater than the clearance.

In the example in FIG. 2, the detection area A is set to "include the clearance: W1" of the clearances: W1 and W2, and is not provided on a side of the clearance: W1. This is because a streaky scratch is produced substantially likewise in an area of the clearance: W1 and an area of the clearance: W2, and detecting the scratch in one clearance is practically sufficient.

Naturally, detection areas may be set to the areas of the clearances: W1 and W2, and sizes of the detection areas may be set over "the entire width of the transfer belt 61".

The reflective photo sensor 200 radiates a plurality of optical spots in the main-scanning direction. An area on which a plurality of optical spots is radiated is the detection area A.

The reflective photo sensor 200 can form the long detection area A, so that "a main-scanning direction relative positional relationship" between the reflective photo sensor 200 and a width direction end portion of a transfer sheet may be relatively rough.

The surface information detecting device 300 can receive a detection signal from the reflective photo sensor 200, and detect "a surface condition of a fixing belt" in the detection area A which is long in the main-scanning direction.

Further, when the width direction end portion of the transfer sheet is included in the detection area A, "a scratch level" and/or "a scratch position (a position in the main-scanning direction)" which are information about a streaky scratch formed by the width direction end portion of a transfer sheet are quantized as surface information of the fixing belt 61. This will be described below.

Meanwhile, the scratch level refers to "a degree of a scratch", that is, "a scratch depth (roughness) or a scratch width (size)".

"The scratch depth" will be supplemented.

When "a scratch (a scratch resulting from contact with the thermistor or the peeling claw, or a streaky scratch)" is produced on the surface of the fixing member, "a contact pressure between the fixing member and a toner image" weakens at the scratch portion as described above, "fixing failure" occurs according to the scratch, and an "image abnormality" which is referred to as "picking (a decrease that an image density decreases)" occurs in the fixed image.

"The scratch depth" in this description is represented as a parameter which represents the degree of an image abnormality by quantizing "a correspondence between the scratch and an image abnormality caused by the scratch".

Next, a specific example of the reflective photo sensor 200 will be described.

FIGS. 3A to 3D are views for explaining a specific example of the reflective photo sensor 200.

X, Y and Z directions are set as illustrated in FIGS. 3A to 3D.

The X direction is "a direction which crosses the conveying direction" in the above description, and is "the main-scanning direction" in the example of the description.

The Y direction corresponds to "the conveying direction". The Z direction is "a direction orthogonal to both of the X and Y directions".

A reference numeral 61S denotes "a surface portion including a detection area (the above-described detection area A)" of the fixing belt 61. Hence, the Z direction is a direction leading to the above "surface portion 61S" from the reflective photo sensor 200.

In FIGS. 3A to 3D, a reference numeral 201 denotes a substrate, reference numerals 202 and 203 denote longitudinal direction lateral plates, reference numerals 205 and 206 denote longitudinal direction lateral plates and a reference numeral 204 denotes a lens element.

Figure 3A:
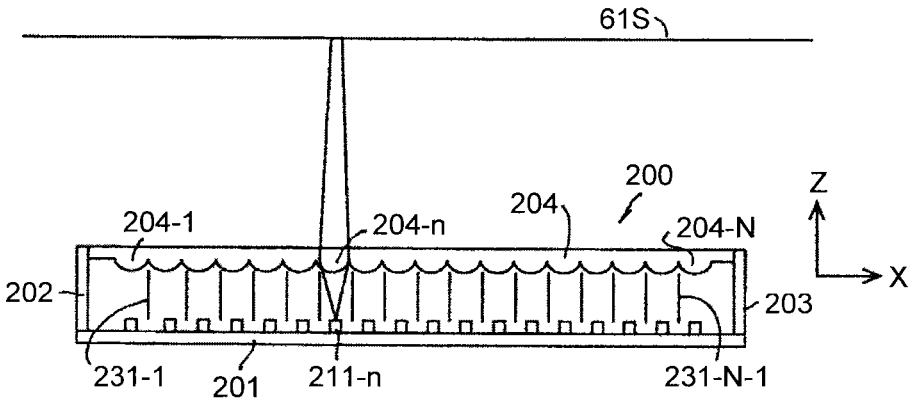
FIGS. 3A to 3D are views for explaining a specific example of a reflective photo sensor.
Figure 3B:
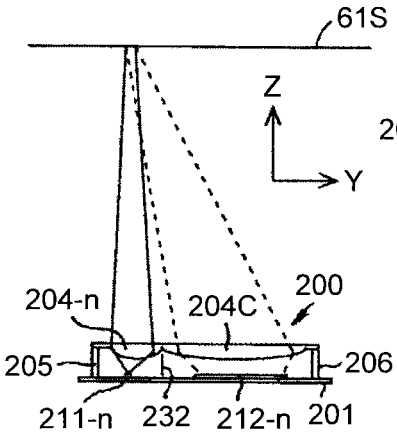
Figure 3C:
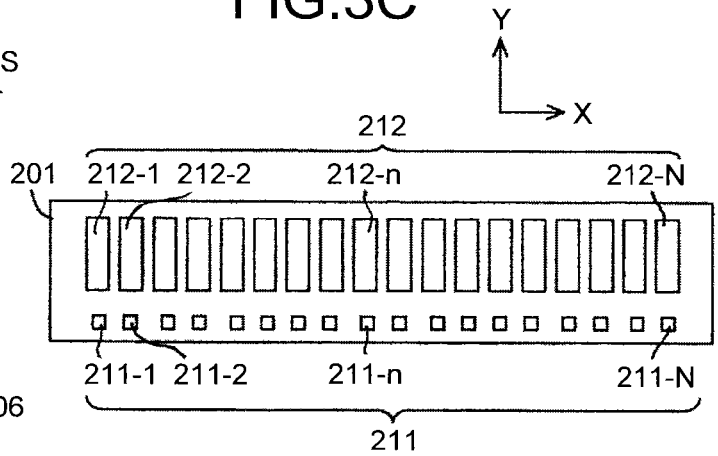

First, FIG. 3C is a view for explaining an alignment state of LEDs (light emitting diodes) and photodiodes (represented as "PD" below) which are photo sensors on the substrate 201, and a reference numeral 211 denotes an LED and a reference numeral 212 denotes a PD.

A plurality of LEDs 211 (although 18 LEDs are drawn in the drawing for ease of description, and the number of LEDs 211 to be aligned is set according to setting conditions and several tens to several hundreds of LEDs can be generally set.) are aligned at equal intervals in the X direction which is the longitudinal direction of the substrate 201.

A plurality of PDs 212 is also aligned at equal intervals in the X direction. In this description, the number of the PDs 212 and the number of the LEDs 211 are equal, and an alignment pitch of the PDs 212 is the same as the alignment pitch of the LEDs 212.

Numbers are sequentially allocated to individual LEDs 211 one by one from the left in FIG. 3C, and the n-th LED from the left in the drawing is the LED 211-*n*. When the total number of LEDs 211 is N, all LEDs 211 are aligned in order of LED 211-1, 211-2, . . . , 211-*n*, . . . and 211-N.

Similarly, numbers are sequentially allocated to the PDs 212 one by one from the left in FIG. 3C, and the n-th PD from the left in the drawing is the PD 212-*n*. The total number of PDs 212 is N, and all PDs 212 is sequentially aligned in order of 212-1, 212-2, . . . , 212-*n*, . . . and 212-N.

The LED 211-*n* (n=1 to N) is associated with the PD 212-*n* (n=1 to N) on a one-on-one basis. As illustrated in FIG. 3C, the LED 211-*n* and the PD 212-*n* which are associated with each other are arranged at "the same position in the X direction mutually" in the Y direction (the direction corresponding to the conveying direction).

Next, a lens element 204 will be described with reference to FIGS. 3A, 3B and 3D.

The lens element 204 is formed with two area portions.

That is, as illustrated in FIGS. 3A and 3B, the two area portions include an area of a radiation lens array in which radiation lenses 204-*n* (n=1 to N) are aligned as an array, and an area of a light receiving lens 204C.

The number of radiation lenses 204-*n* is equal to the number (N) of LEDs 211, and, above the Z direction of the LEDs 211, the individual LEDs 211-*n* and radiation lenses 204-*n* are associated on a one-on-one basis and aligned in the X direction.

Figure 3D:
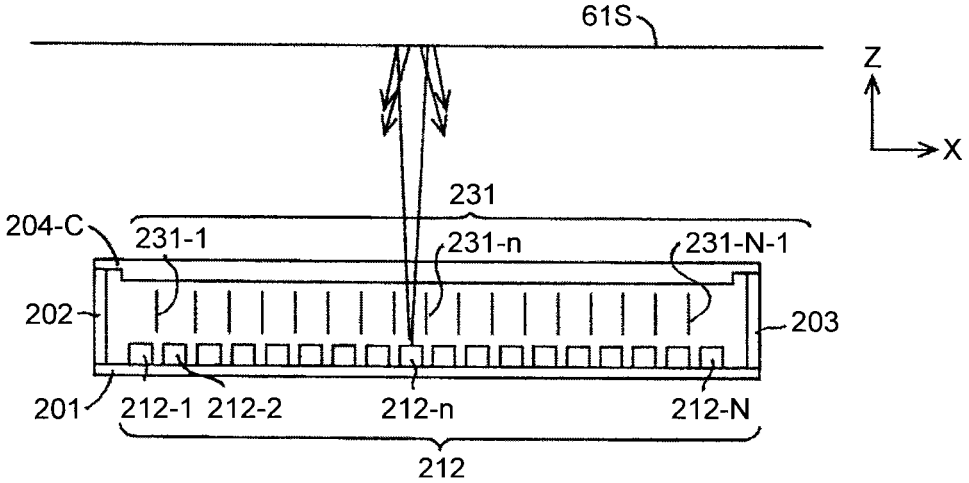

The light receiving lens 204C is "a single cylindrical lens" as illustrated in FIGS. 3B and 3D, and commonly meets the PDs 212-1 to 212-N and is arranged above the Z direction of the PDs 212. In addition, FIG. 3D is "a view" illustrating the reflective photo sensor 200 "seen from a positive direction of Y axis to a negative side".

The light receiving lens 204C has positive power only in the Y direction.

The area of the radiation lens array and the light receiving lens 204C are integrally formed, and are integrally molded by way of resin molding.

In FIGS. 3A and 3D, reference numerals 231-1, 231-2, . . . , 231-*n*, . . . , and 231-N−1 denote light shielding walls which prevent "flare lights" between neighboring sets of "sets of the LEDs 211-*n* and the radiation lens 221-*n*".

Further, the reference numeral 232 illustrated in FIG. 3B denotes a light shielding wall which prevents "a flare light" between an alignment of the LEDs 211-*n* and an alignment of the PDs 212-*n*.

Reference numerals 205 and 206 in FIG. 3B denote lateral plates in the width direction (Y direction). The lateral plates 202, 203, 205 and 206 are integrally formed as a case.

The light shielding walls 231 and 232 can be formed integrally with "the case" by way of resin molding, and the lens element 204 and the light shielding walls 231 and 232 can also be integrally formed by way of resin molding. Further, the lens element 204, the light shielding walls 231 and 232 and "the case" can also be integrally formed by way of resin molding.

As illustrated in FIG. 3A, when the LED 211-*n* is turned on, a radiated "emissive light beam" is condensed by the radiation lens 204-*n* associated with the LED 211-*n*, and is radiated toward a fixing belt surface 61S as an optical spot.

As illustrated in FIG. 3D, a reflected light at "a portion" of the fixing belt surface 61S "radiated by the optical spot" is condensed only in the Y direction by the light receiving lens 222, and is incident on the PD 212-*n*.

Reflection on the fixing belt surface 61S is not specular reflection, the reflected light also widens in the X direction and a PD which receives the reflected light is not "the PD 221-*n* alone".

Next, an operation of the reflective photo sensor 200 will be described using a flowchart illustrated in FIG. 4.

The LEDs 211 from the LED 211-1 at a left end in FIG. 3A to the LED 211-N at the right end (n=1 to N) repeat "turning on or off lights sequentially one by one". This is so-called "sequential lighting".

In synchronization with lighting of the n-th LED 211-*n*, the reflected light from the fixing belt surface 61S is received by a plurality of PDs including the PD 212-*n* facing with the lighted LED 211-*n*.

In this example, for ease of description, the number of PDs which receive lights is "odd" and (2 m+1), and m is an integer.

That is, the reflected light upon lighting of the LED 211-*n* is received by the PD 212-*n* associated with the LED 211-*n* and "m PDs subsequent to both sides thereof".

When, for example, m=2 is true, a plurality of PDs which receives the reflected lights is five PD 212-*n*−2, PD 212-*n*−1, PD 212-*n* (corresponding to the LED 211-*n*), PD 212-*n*+1 and PD 212-*n*+2.

The plurality of PDs photoelectrically converts the amount of received light. The photoelectrically converted signal is amplified to a "detection signal". Each detection signal of each PD is sent to the surface information detecting device 300 per detection.

When sequential lighting is repeated, n=N is true and the LED 211-N at the right end is "turned on and off", which is one cycle, sequential lighting is finished.

Depending on cases, sequential lighting is performed over a plurality of cycles to improve detection precision, and, for example, average value processing of a detection result in each cycle is performed.

In the above description, when n=1 is true and the LED 211-1 is turned on, the three PD 212-1, PD 212-2 and PD 212-3 instead of five PDs receive lights. Further, when n=N is true, the three PD 212-N−2, PD 212-N−1 and PD 212-N instead of five PDs also receive lights.

In light of this situation, instead of "N LED 211-1 to LED 211-N" which are sequentially turned on, two LEDs on both sides and "N−4 LED 211-3 to LED 211-N−2" may be sequentially turned on.

That is, generally speaking, it is not necessary to use all N LEDs 211 which are turned on and off, and it may be possible to use random N' (≤N) LEDs of these LEDs.

Figure 5:
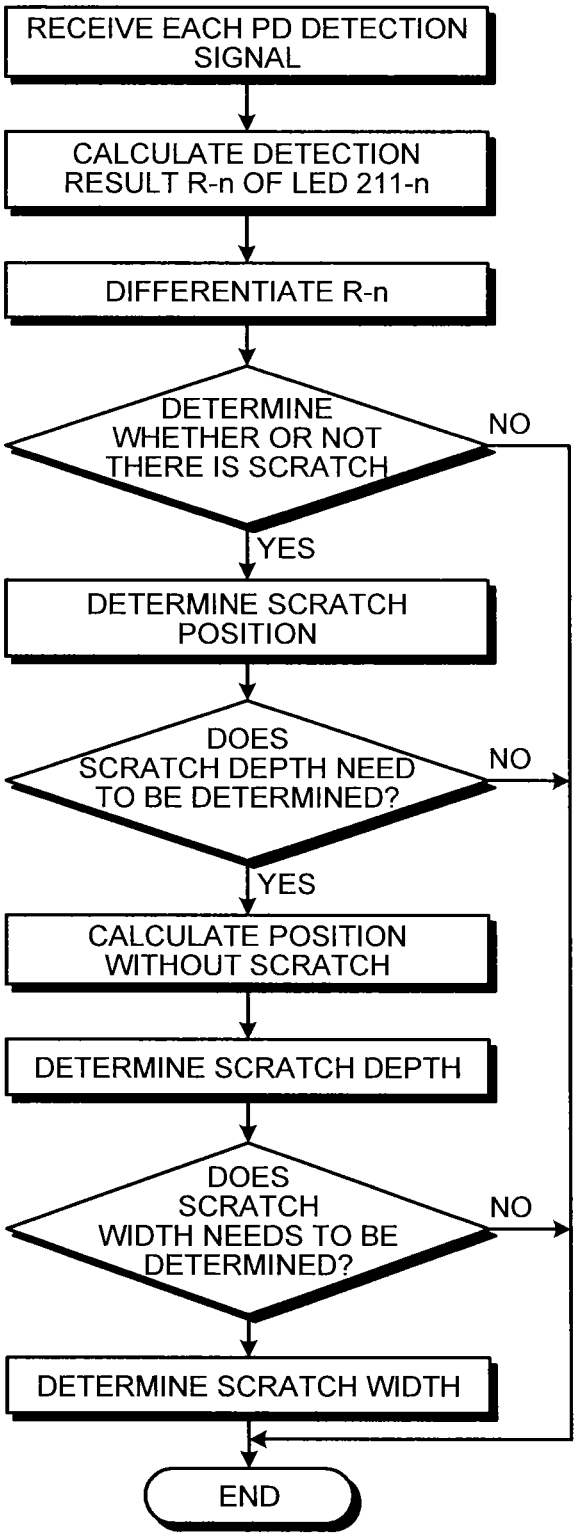
FIG. 5 is a flowchart for explaining a function of a surface information detecting device.

As described above, when the individual LEDs 211 are sequentially turned on and a detection signal is sent to the surface information detecting device 300 per lighting, the surface information detecting device 300 detects surface information as illustrated in FIG. 5.

When receiving detection signals of PDs (212-1 to 212-N) (the number of detection signals is principally (2 m+1) every time one LED is turned on and off), the surface information detecting device 300 computes "the sum" of (2m+1) detection signals as "a detection result: R−n" per reception. n=1 to N is true.

Thus, it is possible to obtain a reflected light intensity: R−n of each optical spot sequentially radiated in the main-scanning direction (each position on the fixing belt surface in the main-scanning direction).

Next, surface information of the fixing belt surface 61S is detected based on the detection result: R−n.

Generally, when there is a scratch on the surface of the fixing belt 61, "a regular reflection component" of a reflected light from the fixing belt surface 61S "decreases" and "a diffuse reflection component thereof increases" compared to a surface without a scratch.

In case of the above example, when the LED 211-*n* is turned on, if there is a scratch at a position of an optical spot to be radiated, the regularly reflected light component decreases at this portion, the amount of light received by the PD 212-*n* decreases and the amount of lights received at the PD 212-*n*−*m* to PD 212-*n*−1 and PD 212-*n*+1 to PD 212-*n*+*m* therearound increases. However, the detection result: R−n of the site at which there is a scratch generally decreases compared to a site without a scratch.

Based on characteristics of such a detection signal, "whether or not there is a scratch", "a scratch level" and "a scratch position (the position in the main-scanning direction)" are quantized as surface information.

Hence, the detection result: R−n obtained as described is "differentiated". There are various differentiating operations, and, hereinafter, the simplest operation of "dividing a difference between R−n and R−n+1 of neighboring detection results: (R−n+1)−(R−n) by an alignment pitch of PDs: P". That is, an operation is to compute "an inclination of neighboring detection results".

Figure 6:
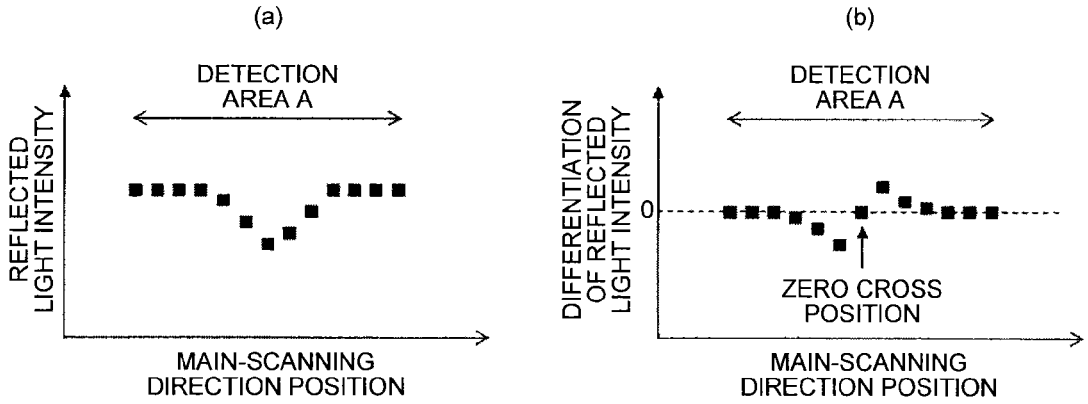
FIG. 6 illustrates an example of a detection result: R−n obtained by sequential lighting of one cycle.

Illustrated in (a) of FIG. 6 is an example of the detection result: R−n obtained by sequential lighting of one cycle.

Although (a) of FIG. 6 illustrates 13 data points for simplification of illustration, the number of data points which is 13 is not significant in particular.

The reflective photo sensor 200 can obtain a reflected light intensity of each position on the fixing belt surface in the main-scanning direction, so that the surface information detecting device 300 can detect a scratch at "a position at which a reflected light intensity decreases" by comparing a plurality of reflected light intensities in the main-scanning direction.

In (a) of FIG. 6, a value of the detection result: R−n (a reflected light intensity of a vertical axis) decreases near a center portion of the detection area A, and this fact shows that "there is a scratch" ("decision as to whether or not there is a scratch" in FIG. 5). Thus, "existence of a scratch" is detected as surface information.

Next, detection of "a scratch position" ("decision of a scratch position" in FIG. 5) will be described.

Illustrated in (b) of FIG. 6 is a result obtained by performing the above differentiating operation of data of a detection result illustrated in (a) of FIG. 6. As is clear from a general differential theory, "a differential value is 0" at a minimum position, and "a differential value changes from a negative to a positive" before and after the minimum position.

Hence, as illustrated in (b) of FIG. 6, it is possible to detect (determine) "a scratch position" by calculating "a zero cross position" at which a differential value "changes from a negative to a positive".

In addition, that "an absolute value of a differential value" is smaller than a predetermined value set in advance indicates that "a decrease in a reflected intensity is small", and it is determined that "there is no scratch".

Hereinafter, a specific example will be described.

The reflective photo sensor 200 illustrated in FIGS. 3A to 3D is configured as described below.

The numbers of aligned LEDs 211 and PDs 212: are N=24, LEDs which are sequentially turned on are n=3 to 22, and alignment pitches of the LEDs 211 and the PDs 212 are 1 mm.

With this reflective photo sensor 200, optical spots are radiated on the fixing belt surface at the pitch of 1 mm.

Figure 7:
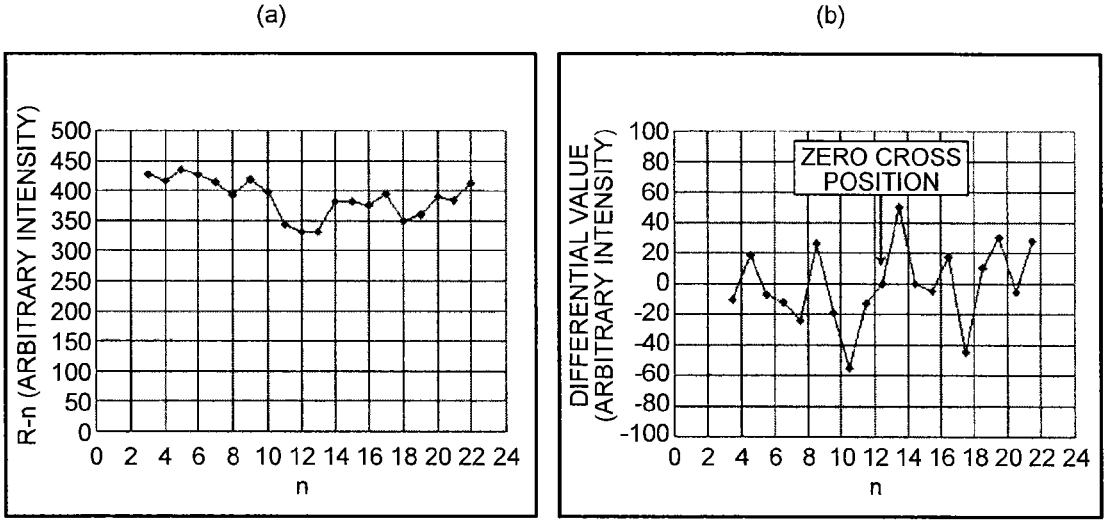
FIG. 7 illustrates an example of a relationship between a detection result: R−n and a main-scanning direction position.

Illustrated in (a) of FIG. 7 is a relationship between the detection result: R−n obtained using the above reflective photo sensor 200 for the fixing belt 61 after fixing is performed with respect to 400,000 transfer sheets (of an A4 size conveyed in the longitudinal direction) and a main-scanning direction position.

An optical spot is radiated on the fixing belt surface at P=1 mm, and n on the horizontal axis in (a) of FIG. 7 is equal to an optical spot radiation position represented in "mm units".

Illustrated in (b) of FIG. 7 is a result obtained by differentiating the detection result in (a) of FIG. 7 in the main-scanning direction.

In addition, it is also possible to calculate "inclinations at three points of R−(n−1), R−n and R−(n+1)" to smooth a differential value.

When "the zero cross position" in (b) of FIG. 7 is calculated as n=12.5, "a position of 12.5 mm" which is an intermediate position of optical spot radiation positions of the LED 211-12 and the LED 211-13 is detected (determined) as a scratch position.

Next, detection (decision) of a scratch level will be described.

A scratch level is the above "scratch depth" or "scratch width", and detection of "the scratch depth" will be described first ("the scratch depth will be determined" in FIG. 5).

Figure 8:
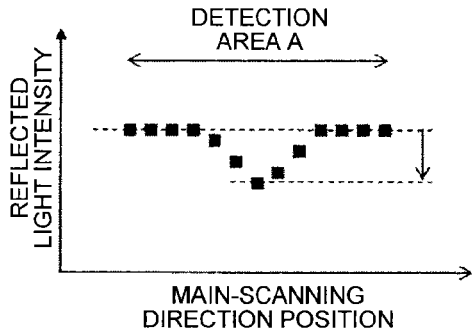
FIG. 8 illustrates detection of a scratch depth.

Qualitatively, "when a scratch depth is deeper, a fixing belt surface is rougher and a decrease in a reflected light intensity is greater". Hence, "a decrease amount of a reflected light intensity" only needs to be calculated to detect "a scratch depth". FIG. 8 illustrates a schematic view of the reflected light intensity.

Although "a minimum value of the detection result: R−n" may be simply calculated when the detection result: R−n (reflected light intensity) is as illustrated in FIG. 8, "an inclination component may be superimposed" on the detection result: R−n due to, for example, an inclination of an attachment posture of the reflective photo sensor 200 and an inclination of the fixing belt.

"The scratch position" can be detected as described above.

A position without a scratch is "a position at which fluctuation of the detection result: R−n is little", that is, "a position at which differential values concentrate near 0". By taking this point into account, it is possible to calculate a position without a scratch from a differentiation result in the main-scanning direction.

Figure 9:
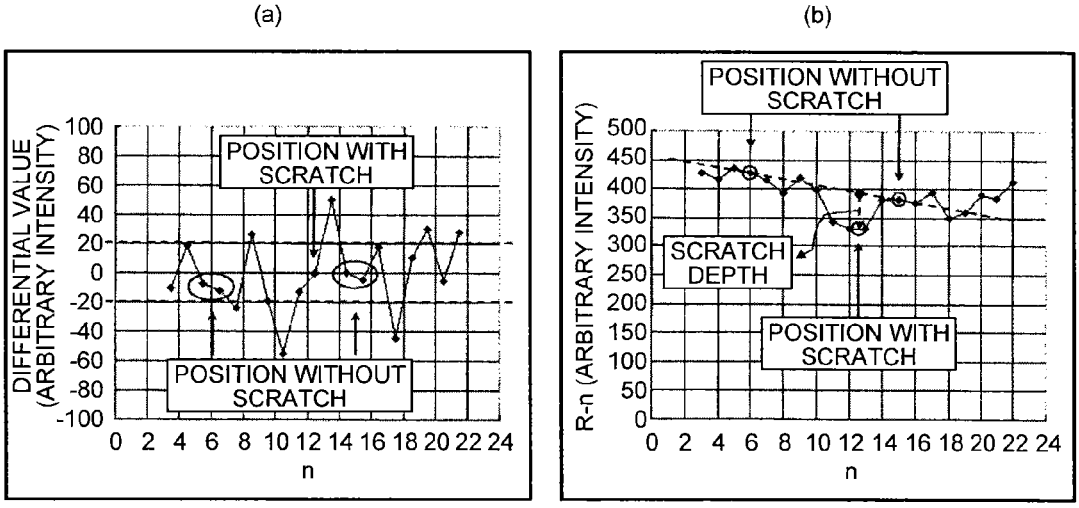
FIG. 9 illustrates detection of a scratch depth.

Referring to FIG. 9, an example will be described where "a decrease amount of a reflected light intensity" is calculated from $R-n_0$: the detection result at the position with a scratch: $n_0$ and $R-n_1$ and $R-n_2$: detection results at least two positions without scratches: $n_1$ and $n_2$.

It is only necessary to calculate a distance between "an approximate line connecting detection results at a plurality of positions without scratches" and detection results at positions at which there are scratches to subtract inclination components to be superimposed on the detection result: R−n.

A case will be described where this method is applied to the results in FIGS. 7A and 7B described above and the decrease amount of the reflected light intensity is calculated.

Illustrated in (a) of FIG. 9 is that "positions at which a plurality of differential values concentrates within a small range of ±20" are calculated for scratch positions from (b) of FIG. 7. From (a) of FIG. 9, n=6 and n=15 can be selected as positions without scratches.

Hence, by extracting a position with a scratch: $n_0$=12.5 and positions without scratches: $n_1$=6 and $n_2$=15 and using the respective detection results: R−n, it is possible to calculate "a scratch depth (roughness)".

A broken line in (b) of FIG. 9 is "a line connecting $Rn-n_1$ and $Rn-n_2$", and corresponds to "a scratch depth of an arrow of a broken line".

In this example, "the scratch depth is 63.1".

"A ratio of a decrease in the reflected light intensity" is 0.16 (16%) at a scratch position.

As described above, "the scratch depth" is represented as a parameter which indicates a degree of an image abnormality by quantizing "a correlation between a scratch and the image abnormality resulting from the scratch", and the scratch depth "63.1" in this example is not "a physical depth of the scratch itself" and a corresponding "degree of the image abnormality (a decrease in a density)" is specified.

As is clear from (b) of FIG. 9, "a scratch depth is superimposed" on the inclination component indicated by a broken line.

When a scratch level (scratch depth) is higher, this "decrease in the reflected light intensity" increases.

A method of detecting "a scratch width (size)" ("deciding a scratch width" in FIG. 5) as one more surface information will be described.

A center position of a scratch is detected as described above.

That is, a position of a reflected light intensity at which "a decrease amount of the reflected light intensity corresponding to a scratch depth (roughness)" decreases a predetermined amount (for example, 50%) is calculated from the detection result: R−n at a position at which there is a scratch.

FIG. 10 is a view enlarging a vertical axis in (b) of FIG. 9.

It is possible to detect (determine) "a half-value width of a scratch" as 3 mm from a result in FIG. 10.

In addition, it may be possible to detect all pieces of surface information (parameters of a surface condition), and determine only necessary parameters.

Although the reflective photo sensor 200 "sequentially turns on" LEDs in the above example, the reflective photo sensor 200 can also simultaneously turn on a plurality of LEDs 211. In this case, a plurality of PDs 212 also receives a reflected light in synchronization with an operational timing of simultaneous lighting.

In this case, the surface information detecting device takes "detection content of the PD 212-*n* associated with the LED 211-*n*" as the detection result: R−n without calculating a sum of detection signals of the PDs 212 as described above.

That is, it is possible to obtain the reflective intensity of each optical spot radiated in the main-scanning direction, that is, "each position on the fixing belt surface in the main-scanning direction".

A mode of a reflective photo sensor is not limited to the above reflective photo sensor 200. A configuration only needs to be employed where "a plurality of optical spots can be radiated" on the surface of the fixing belt "in the main-scanning direction and this reflected light can be received".

Although the above-described reflective photo sensor 200 is "an array type in which a plurality of LEDs and a plurality of PDs face with each other on a one-on-one basis", a reflective photo sensor may also be a beam deflection type which deflects a laser beam by means of a light deflector and receives at one or a plurality of PDs a reflected light from a surface of the fixing belt".

A reflective photo sensor may be a sensor driving type which moves "a photo sensor formed with one LED and one PD" in the main-scanning direction by means of a driving unit.

In the above described embodiment, the reflective photo sensor 200 can be comparatively roughly arranged on one side of a sheet width end portion when an A4 size sheet is conveyed in the longitudinal direction in the main-scanning direction on the surface of the fixing belt 61.

By placing the reflective photo sensor 200 near the sheet width end portion, it is possible to include the sheet width end portion in the detection area A even when the length of the detection area A in the main-scanning direction is made shorter. That is, the detection area A can be made shorter means that there is an advantage of "miniaturizing the reflective photo sensor 200 in the main-scanning direction in particular".

"The scratch width" is about several 100 μm to several mm and a fluctuation range of the scratch position is about several mm, and the detection area A preferably has a size of "about 5 mm to 15 mm in the main-scanning direction".

The image forming apparatus according to the present invention can use "transfer sheets of a plurality of sizes" such as the A3 size, the A4 size and the A5 size.

Generally, a maximum transfer sheet which can be fed is the A3 size, the transfer sheet is frequently conveyed in the longitudinal direction, and surface information such as "a streaky scratch" of a transfer sheet having a size other than the A3 size as "a sheet width of a small size" is a detection target.

If the image forming apparatus can feed A2 size sheets in the longitudinal direction, surface information of a streaky scratch of a transfer sheet having a size other than an A2 size is a detection target.

Although one reflective photo sensor 200 is used in the above example, there are both ends of a conveyance width of the A4 size in the longitudinal direction, so that the two reflective photo sensors 200 in total can be arranged one by one on both sides of the conveyance width.

However, as described above, a streaky scratch is produced at the both end portions virtually likewise and there is not a significant difference in a scratch level, so that arranging the reflective photo sensor only on one side is sufficient as described above.

When one reflective photo sensor is arranged, the reflective photo sensor can adequately detect surface information of a fixing member without being influenced by "characteristic fluctuation or attachment fluctuation of the reflective photo sensor" which occurs when a plurality of reflective photo sensors is used.

Figure 11:
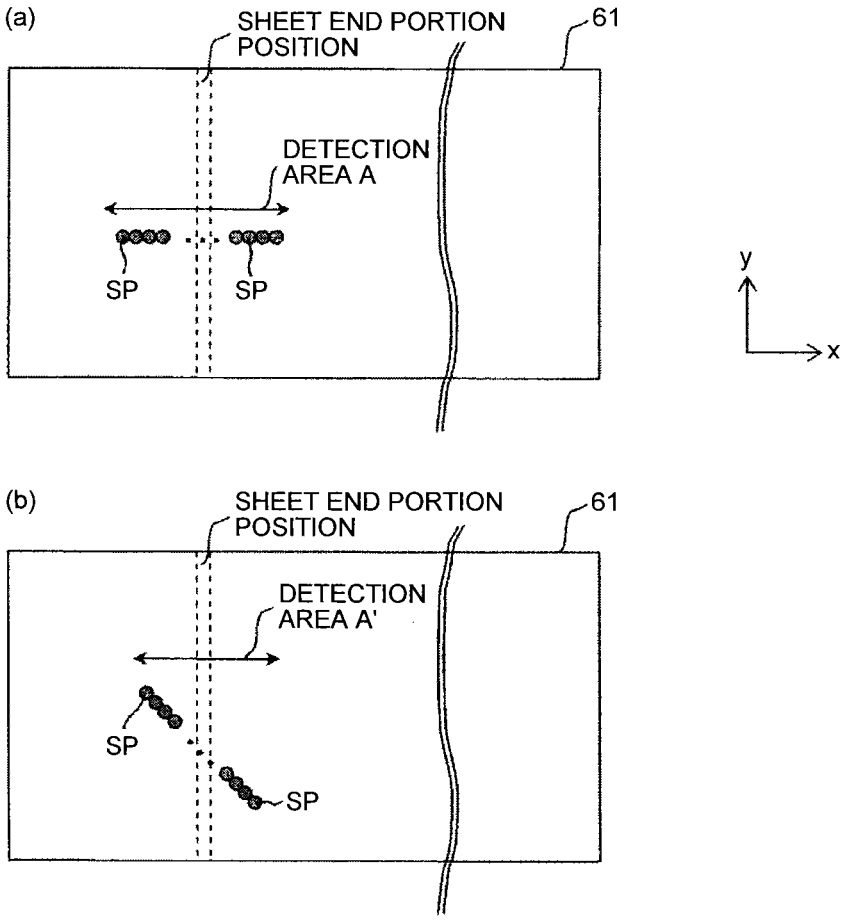
FIG. 11 illustrates two examples of an alignment example of optical spots.

Although, in the above-described example, "an alignment of optical spots" radiated by the reflective photo sensor is "the main-scanning direction" orthogonal to the conveying direction ((a) of FIG. 11 illustrates this case and reference numeral SP denotes optical spots), the alignment of the optical spots is not limited to this.

Illustrated in (b) of FIG. 11 is an example where "the alignment of the optical spots SP is in a direction different from the conveying direction at a right angle", and illustrates that the alignment is inclined at 45 degrees with respect to the conveying direction (Y direction). By so doing, while a detection area A' in the main-scanning direction is "$1/\sqrt{2}$" shorter than the detection area A, an alignment pitch of optical spots in the main-scanning direction can also be decreased to $1/\sqrt{2}$ and, consequently, it is possible to improve position resolution of a detection result.

Although surface information of "a streaky scratch" on the fixing belt is a main detection target in the above-described embodiment, the detection target is not limited to this and may be the above offset or "a scratch resulting from contact with the thermistor or the peeling claw".

In case of, for example, an offset, when a toner condition adhered to the fixing belt surface is a "film shape", a decrease of the reflected light intensity: R−n which is a detection result is "relatively small and is in a wide range", so that a scratch can be detected from this characteristic.

Further, while "a streaky scratch width" is about several 100 μm to several mm as described above, the width of "a scratch resulting from contact with the thermistor or the peeling claw" is "several 10 μm to several 100 μm" and an occurrence position of the scratch is substantially determined, so that it is possible to identify a "streaky scratch" based on the detection position and the scratch width.

Although "the fixing belt" has been described as the fixing member above, the fixing member is not limited to this, and it goes without saying that the fixing roller can also be used.

However, when the fixing belt is used as the fixing member, while "a fixing belt formed using a material of high surface hardness such as PFA for a surface layer in particular" is likely to be damaged so that it is important to detect surface information, while management to, for example, exchange a belt becomes easy by detecting surface information using a reflective photo sensor.

The surface information of a fixing member surface may be "information related to a conveying direction streaky scratch resulting from contact between a sheet recording medium or a fixing member surface" as in the above-described example, it is possible in this case to simultaneously detect a scratch level (a scratch depth or a scratch width) and a scratch position in the main-scanning direction as surface information.

When surface information of the fixing member surface is information related to a scratch level and a scratch position of a streaky scratch, by specifying the scratch position by a differentiating operation of a plurality of detection results: R−n in an alignment direction of the optical spots, it is possible to precisely calculate an inflection point of the detection result and precisely calculate the scratch position.

Further, when a scratch level is determined from the detection result at the scratch position and detection results of at least two positions at which absolute values of differential values resulting from the differentiating operation of a plurality of detection results concentrate near zero as described above, detection results at positions without a scratch are also used, so that it is possible to "remove an inclination component to be superimposed" and precisely calculate a scratch level.

Furthermore, by "sequentially radiating" a plurality of optical spots on a fixing member surface "in a direction which crosses the conveying direction", crosstalk (reflected lights from a plurality of LEDs are simultaneously received when seen from one PD) is canceled compared to simultaneous radiation, so that it is possible to improve detection precision of a detection result obtained from each optical position in the main-scanning direction.

The reflective photo sensor is not limited to the above reflective photo sensor 200, and can adopt a structure which has N (≥1) LEDs aligned in one direction, M (N≥M≥1) lenses which condense lights from the individual N LEDs on a fixing member surface as optical spots and K (N≥K≥1) photo sensors which receive a reflected light from the fixing member surface at each optical spot.

In this case, a plurality of LEDs is associated with one condenser lens, and a structure of a condenser lens array is simplified. In such a case, photo sensors may have single light receiving surface. When the condenser lens becomes larger, the condenser lens can also be used as a light receiving lens for the photo sensors.

Consequently, the above image forming apparatus can effectively detect not only an offset of a fixing member and "a scratch resulting from contact with the peeling claw or the thermistor" but also "a streaky scratch produced by contact with a sheet recording medium" in particular, and maintain good fixing performance by learning surface information of the fixing member.

Next, "a change of a fixing belt surface condition" changed by the surface condition changing device will be described.

As described above, the surface condition change roller 67 has "a surface layer which has predetermined roughness (which is rougher than roughness of a surface of the fixing belt 61) in a metal cored bar".

Figure 12:
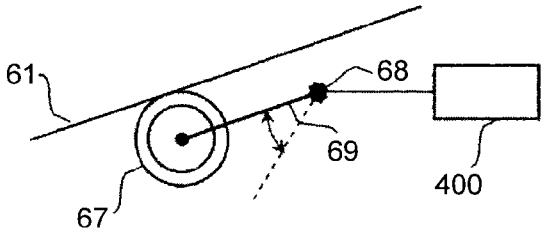
FIG. 12 illustrates contact with and separation from a fixing belt of a surface condition change roller.
Figure 12:
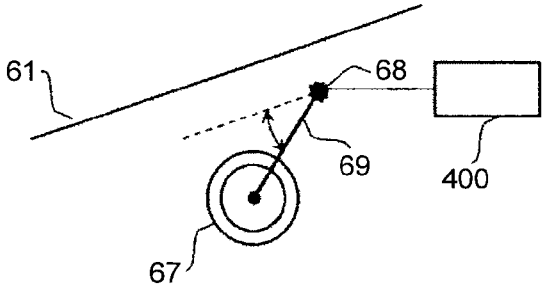

As illustrated in FIG. 12, the surface condition change roller 67 is supported by a rod 69.

The rod 69 is connected to a rotating shaft 68, and these rod 69 and rotating shaft 68 are controlled and driven by the surface condition change control device 400.

The rod 69 and the rotating shaft 68 are simplified illustrations of the above "driving unit".

Illustrated in (a) of FIG. 12 is a state in which the surface condition change roller 67 is in contact with the surface of the fixing belt 61, and illustrated in (b) of FIG. 12 is a state in which the surface condition change roller 67 is separated from the fixing belt 61.

Thus, the surface condition change roller 67 can contact with and separate from the fixing belt 61.

The surface condition is changed according to the following process.

Figure 4:
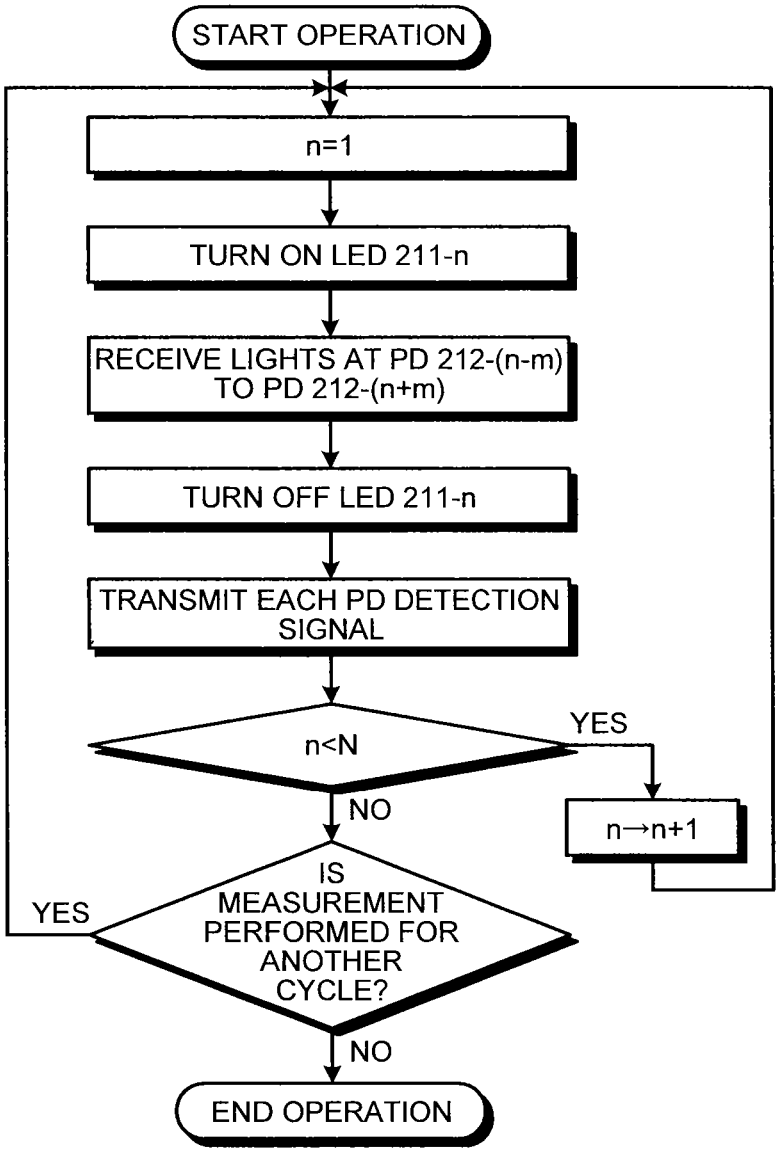
FIG. 4 is a flowchart for explaining an operation of the reflective photo sensor illustrated in FIGS. 3A to 3D.
Figure 13:
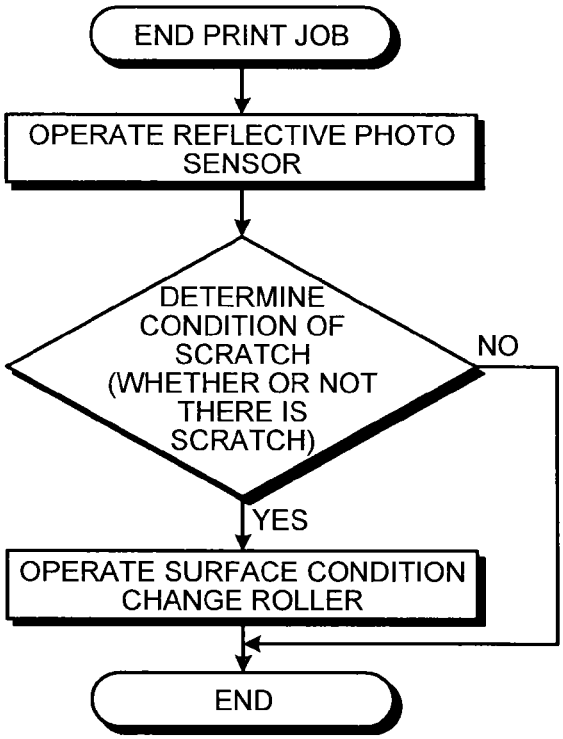
FIG. 13 is a flowchart illustrating an operation of the surface condition change roller.

After "a print job is finished (image forming process is finished)" as illustrated in FIG. 13, the fixing belt 61 is driven to rotate, the reflective photo sensor 200 is operated according to a flowchart in FIG. 4 and, when the operation is finished, the surface information detection unit 300 detects (determines) the surface condition of the fixing belt 61 according to the flowchart illustrated in FIG. 5. When "there is no scratch"

as a result of decision, surface condition change control process is finished without driving the surface condition change roller.

When the surface information detection unit 300 "detects existence of a scratch", the surface condition change control device 400 controls "the operation of the surface condition change roller 67" as follows in response to a detection result from the surface information detection unit 300.

Figure 14:
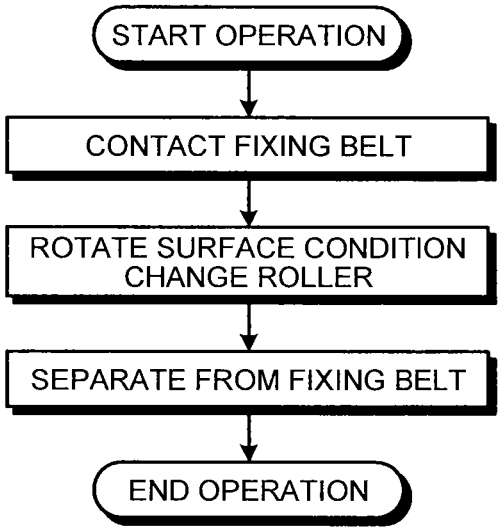
FIG. 14 is a flowchart illustrating an operation of the surface condition change roller.

FIG. 14 is a flowchart illustrating "the operation of the surface condition change roller 67".

The surface condition change roller 67 usually "evacuates to a position apart from the fixing belt 61", and, after "the operation starts", the surface condition change roller 67 is first placed in contact with the fixing belt 61 and then the surface condition change roller 67 is driven to rotate.

The surface condition change roller 67 is set in advance to include "a rotation time matching a scratch level", and is driven to rotate for a predetermined period of time matching "the scratch level" detected by the surface information detection unit 300.

By this means, "the surface layer" of the surface condition change roller 67 "which has predetermined roughness" rotates in contact with the surface of the fixing belt 61, so that a portion of "a streaky scratch formed at a sheet width portion of a transfer sheet" on the surface of the fixing belt 61 is scraped and "a new surface portion" is exposed.

That is, the surface condition of the fixing belt 61 is changed. The degree of the change depends on the rotation time of the surface condition change roller 67.

After "the above rotation for a predetermined period of time", the surface condition change roller 67 is separated from the fixing belt 61 and stops rotating, evacuates to an initial position and finishes the operation of the surface condition change roller 67.

"A surface condition change" performed by the surface condition change roller 67 is not limited to the above example, and may also adopt the following mode.

Figure 15:
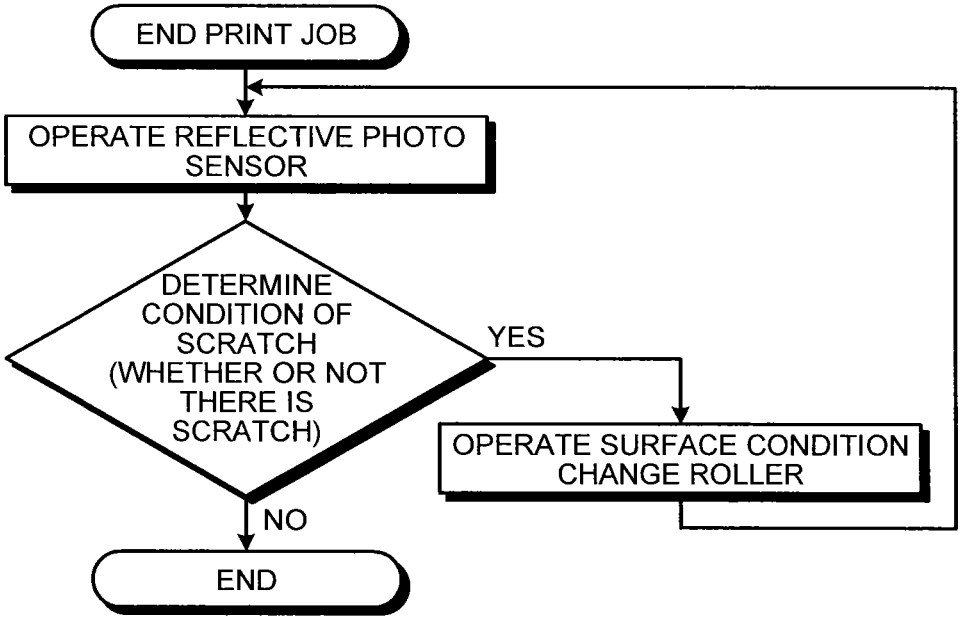
FIG. 15 is a flowchart as an explanatory view illustrating an example of surface condition change.

A flowchart illustrated in FIG. 15 is as follows.

After "the print job is finished (the image forming process is finished)", the fixing belt 61 is further driven to rotate, and the reflective photo sensor 200 is operated according to the flowchart in FIG. 4. When the operation is finished, the surface information detection unit 300 determines a surface condition of the fixing belt 61 (detects surface information) according to the flow in FIG. 5. When "there is no streaky scratch" as a result of decision, the control process is finished without driving the surface condition change roller.

When "existence of a streaky scratch" becomes obvious as a result of decision, the surface condition change control device 400 controls the operation of the surface condition change roller 67 as described above in response to a detection result from the surface information detection unit 300.

After the operation of the surface condition change roller 67 is finished, the reflective photo sensor 200 is operated again and the surface information detection unit 300 determines a surface condition of the fixing belt 61. In order to control this operation, the surface condition change control device 400 controls the reflective photo sensor 200 and the surface information detection unit 300 as illustrated in FIG. 1C.

By this means, it is possible to check whether or not "the surface condition of the fixing belt is changed to a condition without a scratch". The reflective photo sensor 200 can radiate a plurality of optical spots, so that it is possible to check not only a scratch position but also that an entire radiation area becomes a uniform condition without a scratch.

Further, if a scratch is still left after checking, the surface condition change roller 67 is operated again and a series of operations can be repeated until a streaky scratch is removed.

Thus, it is possible to obtain "a condition without a scratch" of the fixing belt.

Figure 16:
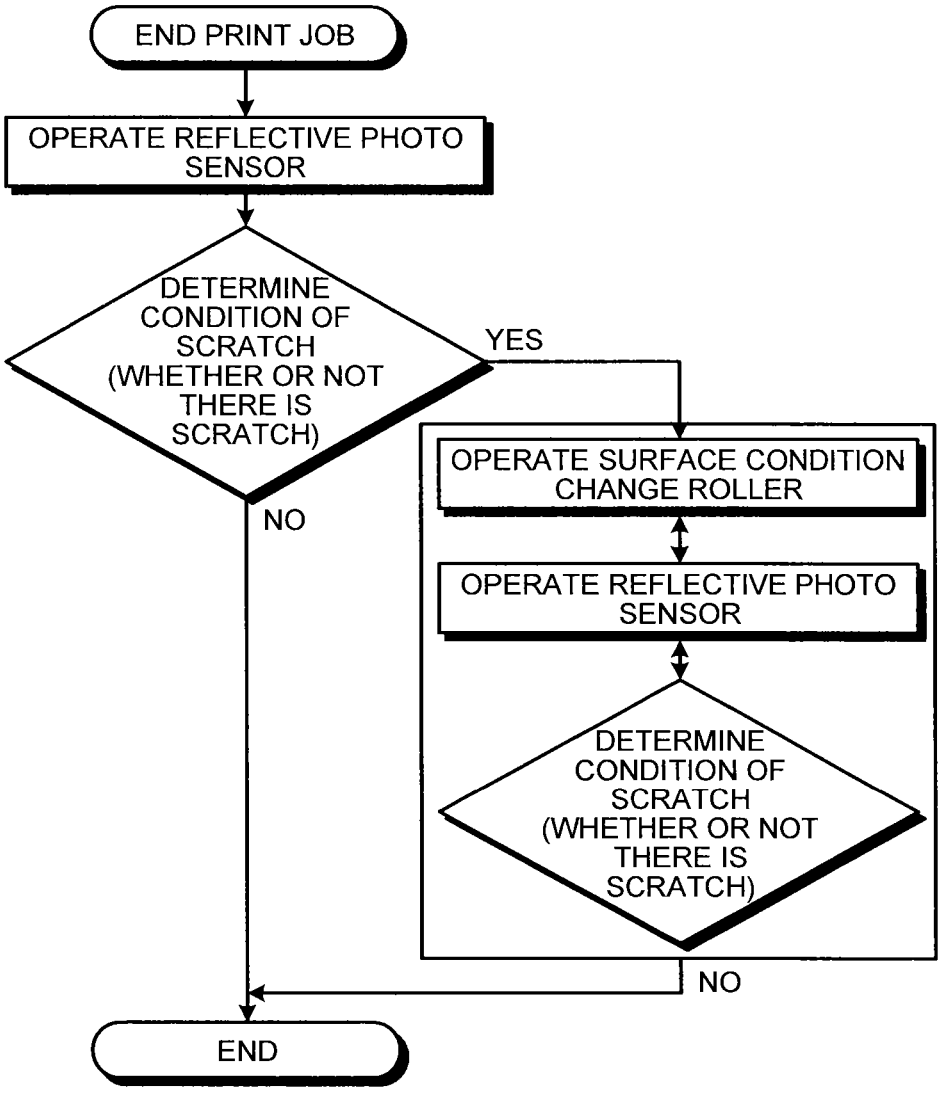
FIG. 16 is a flowchart as an explanatory view illustrating another example of surface condition change.

FIG. 16 is a flowchart as an explanatory view illustrating "another example of surface condition change".

After the print job is finished, the reflective photo sensor 200 is operated as illustrated in FIG. 4 while driving the fixing belt 61 to rotate. When the operation is finished, the surface information detection unit 300 determines the surface condition of the fixing belt 61 according to the flow in FIG. 5.

If there is no streaky scratch as a result of decision, control process is finished without operating the surface condition change roller 67.

When existence of "the streaky scratch" turns out as a result of decision, the surface condition change control device 400 controls the surface condition change roller 67 in response to a result from the surface information detection unit 300.

The surface condition change roller 67 is controlled to drive according to the flow in FIG. 12, and, in this case, the reflective photo sensor 200 is also operated in parallel to rotary drive of the surface condition change roller 67 and the surface information detection unit 300 determines a surface condition of the fixing belt 61 in real time.

That is, the surface condition change roller 67 is driven to rotate while a surface condition is determined, and continues to be driven to rotate until it is determined that "there is no scratch".

Also in this case, the reflective photo sensor 200 can radiate a plurality of optical spots, so that it is possible to check whether or not the fixing roller surface has a uniform condition without a scratch "not only at a scratch position but also over the entire radiation area".

When a "condition without a scratch" is detected, the surface condition change roller 67 is separated from the fixing belt 61 and stops being driven to rotate, the operation of the reflective photo sensor 200 is finished and the surface condition changing process is finished.

By this means, by "required minimum rotary drive of the surface condition change roller", it is possible to reliably obtain a surface condition without a scratch on the fixing belt surface.

The surface condition change roller changes a surface condition of the fixing belt at a site at which a streaky scratch is produced, and does not need to be arranged to achieve this object.

In the example in FIG. 2, the clearances: W1 and W2 have been described as areas in which scratches are produced in this case. In such a case, the surface condition change roller needs to be arranged at the clearances: W1 and W2.

Figure 17:
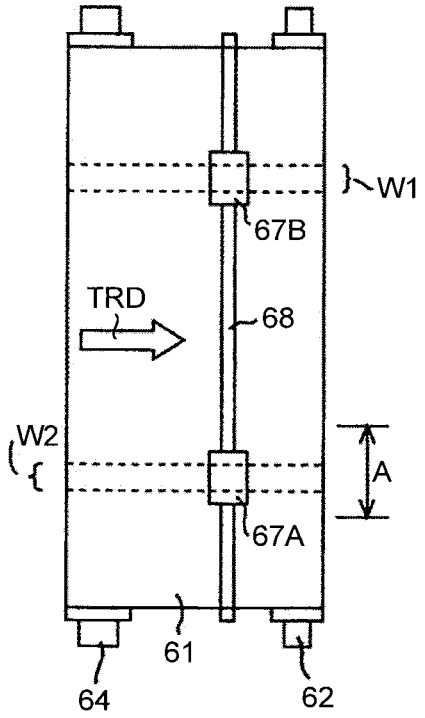
FIG. 17 is a view for explaining an example of an arrangement of surface condition change rollers.

FIG. 17 illustrates an arrangement example of this case.

In this example, two surface condition change rollers 67A and 67B are provided on a rotating shaft 68, and one roller contacts with and separates from a surface area including the clearance: W1 and the other roller contacts with and separates from an area including the clearance: W2.

To both of the two surface condition change rollers 67A and 67B, lengths in a rotating shaft 68 direction which are "narrower than the detection area A and are slightly larger than the clearances: W1 and W2" are set.

Further, a reflective photo sensor which is not illustrated can be displaced in a direction orthogonal to the conveying direction according to a "size" of a transfer sheet "in a direction orthogonal to the conveying direction" (then the position of the detection area A also changes), so that the surface condition change rollers 67A and 67B can move along the rotating shaft 68.

Figure 18:
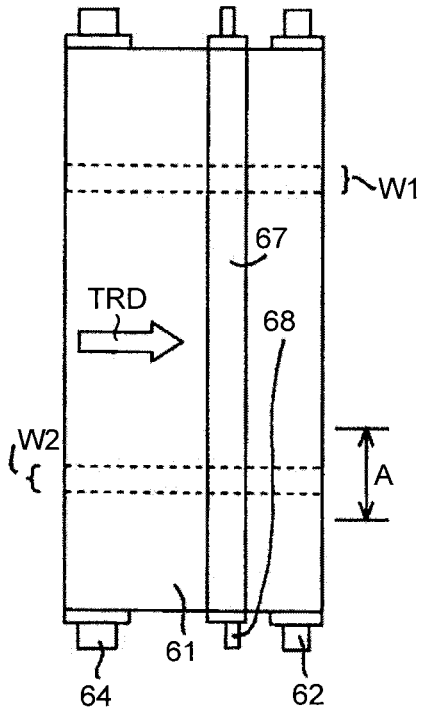
FIG. 18 is a view for explaining another example of an arrangement of the surface condition change rollers.

In an arrangement example illustrated in FIG. 18, the surface condition change roller 67 has "a length which is slightly longer than the width of the fixing belt 61 (the length in the direction orthogonal to the conveying direction)", so that it is possible to change a surface condition over the entire area of the fixing belt 61 in the width direction.

By so doing, it is possible to not only scrape "a streaky scratch" formed at a width end portion of a transfer sheet and improve the surface, and uniformly improve the surface over the entire width of the belt and effectively "change a surface condition" such as a scratch or an offset produced by a separating claw or a temperature sensor.

As described above, flashes of the reflective photo sensor 200 can be "simultaneously turned on" and, in this case, although a plurality of PDs 212 can receive reflected lights in synchronization with an operational timing of simultaneous lighting, the surface information detection unit 300 can obtain the reflective light intensity: R–n of each optical spot radiated in the main-scanning direction, in other words, "each position on the fixing belt surface in the main-scanning direction" by using the detection result: R–n of each PD 212-*n* associated with each LED 211-*n* without calculating "a sum of detection signals".

The present invention can detect a position and a width of a streaky scratch as surface information and "change a surface condition" only when detecting existence of a scratch, so that it is possible to prevent in advance deterioration of quality of an image to be formed and slow down deterioration of the fixing member.

Further, it is possible to provide an image forming apparatus which, by improving a condition of the fixing member surface, slows down a progress of a scratch, increases an interval to exchange a fixing member and reduces cost and a down time.

Furthermore, the surface condition changing device can "change a surface condition according to a scratch level" by "controlling a time to slide against a surface in contact with the fixing member surface".

Still further, by changing a surface condition of a fixing member and then detecting surface information of the fixing member again, it is possible to check the degree of a change in the surface condition and reliably obtain a good surface condition.

By detecting surface information of the fixing member while changing the surface condition of the fixing member, it is possible to check the degree of change in the surface condition at all times and (minimize deterioration of the fixing member and) reliably obtain a good surface condition according to a required minimum operation of a surface condition changing unit.

As described above, the surface condition changing device is controlled to slide on the fixing member surface based on surface information detected by the surface information detecting device, so that it is possible to repair a scratch on the fixing member surface by way of the above sliding and effectively prevent the life of the fixing member surface from being made shorter due to a scratch, and effectively prevent "a life of a fixing member from being made shorter due to the above sliding" by setting "an abrasion amount resulting from sliding" of the surface changing unit against the fixing member surface to a necessary amount and extend the life of the fixing member.

Consequently, the image forming apparatus which uses this fixing device can have a longer life of the fixing device and, consequently can form good images for a long period of time.

The present invention provides an effect of effectively detecting not only an offset on a fixing member and "a scratch resulting from contact with a peeling claw or a thermistor" but also "a streaky scratch produced by contact with a sheet recording medium" in particular, and maintaining good fixing performance by learning surface information of the fixing member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a photoconductive photoconductive element;

a charging device configured to uniformly charge a photoconductive surface of the photoconductive element;

an image writing device configured to write an image in the charged photoconductive element by means of light to form an electrostatic latent image;

a developing device configured to visualize the formed electrostatic latent image as a toner image;

a transfer device configured to transfer the toner image to a sheet recording medium;

a fixing device configured to fix the transferred toner image onto the sheet recording medium; and a surface information detecting device configured to detect surface information of a fixing member of the fixing device, the surface information of the fixing member being information related to at least a depth or a width of a scratch of the fixing member, wherein the surface information detecting device radiates a plurality of optical spots on a surface of the fixing member in a direction crossing a conveying direction, receives and detects a reflected light of each optical spot, and detects the surface information of the fixing member based on a plurality of detection results of the reflective lights, the scratch is in the conveying direction, the surface information of the fixing member is information related at least one of a scratch level and a scratch position of the scratch, the surface information of the fixing member is information related to the scratch level and the scratch position of the scratch, the surface information detecting device specifies the scratch position by differentiating a plurality of detection results in an alignment direction of the optical spots, and the surface information detecting device determines the scratch level based on a detection result of the scratch position and detection results at least two positions at which absolute values of differential values which are results of the differentiating operation of a plurality of detection results concentrate near zero.

2. The image forming apparatus according to claim 1, wherein another image forming apparatus is not included.

3. The image forming apparatus according to claim 1, wherein the fixing member of the fixing device is a fixing belt.

4. An image forming apparatus comprising:

a photoconductive photoconductive element;

a charging device configured to uniformly charge a photoconductive surface of the photoconductive element;

an image writing device configured to write an image in the charged photoconductive element by means of light to form an electrostatic latent image;

a developing device configured to visualize the formed electrostatic latent image as a toner image;

a transfer device configured to transfer the toner image to a sheet recording medium;

a fixing device configured to fix the transferred toner image onto the sheet recording medium; and a surface information detecting device configured to detect surface information of a fixing member of the fixing device, the surface information of the fixing member being information related to at least a depth or a width of a scratch of the fixing member, wherein the surface information detecting device radiates a plurality of optical spots on a surface of the fixing member in a direction crossing a conveying direction, receives and detects a reflected light of each optical spot, and detects the surface information of the fixing member based on a plurality of detection results of the reflective lights;

the surface information detecting device sequentially radiates a plurality of optical spots on the surface of the fixing member in the direction crossing the conveying direction;

the surface information detecting device includes

N LEDs aligned in a direction, where N≥1,

M lenses configured to condense lights from the N LEDs on the surface of the fixing member as optical spots where N≥M≥1; and K photo sensors configured to receive reflected lights at respective spots on the surface of the fixing member, where N≥K≥1; and a toner image is allowed to be fixed to sheet recording media of a plurality of sizes of different widths in the conveying direction; and the surface information detecting device is arranged near a width direction end portion including width direction end portions of sheet recording media including sizes other than a maximum size.

5. An image forming apparatus comprising:

a photoconductive photoconductive element;

a charging device configured to uniformly charge a photoconductive surface of the photoconductive element;

an image writing device configured to write an image in the charged photoconductive element by means of light to form an electrostatic latent image;

a developing device configured to visualize the formed electrostatic latent image as a toner image;

a transfer device configured to transfer the toner image to a sheet recording medium;

a fixing device configured to fix the transferred toner image onto the sheet recording medium;

a surface information detecting device configured to detect surface information of a fixing member of the fixing device, the surface information of the fixing member being information related to at least a depth or a width of a scratch of the fixing member;

a surface condition changing device configured to contact with and separate from a surface of the fixing member, the surface condition changing device having a surface that is rougher than the surface of the fixing member; and a surface condition change control device configured to control contact with and separation from the fixing member of the surface condition changing device based on the surface information detected by the surface information detecting device, and to change a surface condition of the fixing member, wherein the surface information detecting device radiates a plurality of optical spots on the surface of the fixing member in a direction crossing a conveying direction, receives and detects a reflected light of each optical spot, and detects the surface information of the fixing member based on a plurality of detection results of the reflective lights.

6. The image forming apparatus according to claim 5, wherein the surface information of the fixing member detected by the surface information detecting device is information related to a scratch level and a position of the scratch in a direction orthogonal to the conveying direction.

7. The image forming apparatus according to claim 6, wherein the surface condition change control device controls a contact time of the surface condition changing device with the surface of the fixing member according to information related to the detected scratch level.

8. The image forming apparatus according to claim 5, wherein the surface condition changing device changes a surface condition of the fixing member near at least a position of the scratch in the direction orthogonal to the conveying direction.

9. The image forming apparatus according to claim 8, wherein the surface condition changing device changes the surface condition of the fixing member over an entire area of the surface of the fixing member in the direction orthogonal to the conveying direction.

10. The image forming apparatus according to claim 5, wherein, at a same time when or after the surface condition changing device changes the surface condition, the surface condition detecting device detects the surface information of the fixing member.

11. The image forming apparatus according to claim 10, wherein, after the surface condition changing device changes the surface condition, the surface condition detecting device detects the surface information of the fixing member, and changes the surface condition according to the detected surface information.

12. The image forming apparatus according to claim 5, wherein the surface information detecting device sequentially radiates the plurality of optical spots in the direction crossing the conveying direction of the fixing member.

13. The image forming apparatus according to claim 5, wherein the surface information detecting device radiates the plurality of optical spots in a direction different from a horizontal direction orthogonal to the conveying direction of the fixing member.

14. An image forming method comprising:

uniformly charging a photoconductive surface of a photoconductive element;

writing an image in the charged photoconductive element by means of light to form an electrostatic latent image;

visualizing the formed electrostatic latent image as a toner image;

transferring the toner image to a sheet recording medium;

fixing the transferred tuner image to the sheet recording medium by a fixing device;

radiating a plurality of optical spots on a surface of a fixing member of the fixing device in a direction crossing a conveying direction;

receiving and detecting reflective lights of respective optical spots;

detecting surface information of the surface of the fixing member based on a plurality of detection results of the reflective lights, the surface information of the fixing member being information related to at least a depth or a width of a scratch of the fixing member;

providing a surface condition changing device configured to contact with and separate from the surface of the fixing member, the surface condition changing device having a surface that is rougher than the surface of the fixing member;

controlling contact with and separation from the fixing member of the surface condition changing device based on the detected surface information; and changing a surface condition of the fixing member.

* * * * *